United States Patent [19]

Tabor

[11] Patent Number: 4,736,914

[45] Date of Patent: Apr. 12, 1988

[54] TWO-STRING DELTA-STYLE KITE

[76] Inventor: Donald C. Tabor, 4966 Santa Monica Ave., Suite K, San Diego, Calif. 92107

[21] Appl. No.: 73,996

[22] Filed: Jul. 16, 1987

Related U.S. Application Data

[63] Continuation of Ser. No. 804,778, Dec. 5, 1985, abandoned.

[51] Int. Cl.[4] ..... B64C 31/06; A63H 27/08

[52] U.S. Cl. ..... 244/153 R; 244/155 A

[58] Field of Search ..... 244/153 R, 155 R, 155 A, 244/DIG. 1.1; D21/88, 89

[56] References Cited

U.S. PATENT DOCUMENTS

| | | | |
|---|---|---|---|
| D. 274,827 | 7/1984 | Belloff | D21/88 |
| 1,824,324 | 9/1931 | Bradford | 244/153 R |
| 3,347,500 | 11/1967 | Hartig | 244/153 R |
| 3,796,399 | 3/1974 | Wechsler | 244/DIG. 1.1 |
| 4,116,406 | 9/1978 | Hamilton | 244/DIG. 1.1 |
| 4,286,762 | 9/1981 | Prouty | 244/153 R |

FOREIGN PATENT DOCUMENTS

| | | | |
|---|---|---|---|
| 2854939 | 7/1980 | Fed. Rep. of Germany | 244/DIG. 1.1 |

OTHER PUBLICATIONS

David Pelham, *Kites,* 1976, p. 199.
Kite Lines, Summer-Fall 1985.

*Primary Examiner*—Joseph F. Peters, Jr.
*Assistant Examiner*—Lynn M. Fiorito
*Attorney, Agent, or Firm*—Brown, Martin, Haller & Meador

[57] ABSTRACT

An easily assembled, steerable two-string kite suitable for sailing in light or strong winds having self-adjusting wing members, a substantially delta-shaped frame made of lightweight material and covered with flexible sail material capable of in-flight maneuvers including maintaining constant speed over a wide angle relative to the ground, direct overhead flight, 90-degree turns relative to the center of the kite, and lift-off from the ground, all without need to adjust or alter the position of the strings affixed to the kite.

13 Claims, 4 Drawing Sheets

TWO-STRING DELTA-STYLE KITE

This is a continuation of application Ser. No. 804,778 filed Dec. 5, 1985 and abandoned July 16, 1987.

BACKGROUND OF THE INVENTION

A variety of kites are presently commercially available for recreational purposes, or for use by the serious competitor aiming to excel at competition kite-sailing. Depending on the design of a particular kite and the materials used to construct it, it may be flown in light or moderate winds and maneuvered to exhibit aerial feats of different degrees of difficulty.

Kites generally fall into two broad categories: those that are flown with a single string and those flown with two strings affixed to the kite. A variety of single-string kites are well-known, including the Chinese kite, barrel kite, Malay kite, Marconi-jib kite, and Indian-fighter kite. While there are significant differences in the wind speed single-string kites can be flown at, as well as the type of maneuvers each can perform, it is generally true that they perform best in low to moderate winds and are incapable of exhibiting radical aerial maneuvers such as direct overhead flight and dramatic turns accompanied by nearly parallel flight to the ground. Because of the limited weather conditions and limited maneuverability in which single-string kites can be flown, two-string kites that exhibit a wide range of desirable properties have been accepted among kite enthusiasts.

As is apparent from the name, a primary feature of two-string kites is the attachment of two strings of equal length to the kite, one to the right and left sides of the kite, respectively. By pulling on either of the strings, the kite enthusiast can put a two-string kite through exceptional maneuvers. Indeed, the maneuverability of two-string kites is due to constant adjustment of the tension on the string. When tension is applied to either the right or left string, the kite responds by moving in the corresponding direction. If tension is continuously applied evenly on one string, the kite turns continuously in that direction. For example, a clockwise spin is imparted to the kite by pulling in on the right string and stopped by sequentially pulling in on the left string. By exerting even tension on both lines after a particular line of flight is established, the direction of flight can be conserved. Thus, a variety of aerial maneuvers can be performed by sequentially pulling on either the right or left strings.

A feature that distinguishes single-string from dual-string kites is the flight angle of attack. Single-string kites fly at a near fixed angle of attack to the ground, whereas dual-string kites exhibit a variable angle of attack. When the angle of attack is great, a dual-string kite is capable of obtaining high speeds and performing rapid turns. The maximum angle of attack occurs when the kite is nearly parallel to the ground and the wind is at the back of the person controlling the strings.

Several dual-string kites are presently commercially available with names that adequately describe their raucous aerial maneuverability, such as Sky Cat, Sky-Ro-Gyro, and Super Stuntor. Regardless of the type of kite, however, they all share several undesirable features that limit the conditions under which they can be flown or the types of maneuvers that they are capable of performing, even in the hands of an experienced kite flier. First, all the kites require that they be launched by hand, or, alternatively, that the flier be highly experienced to launch it alone. Thus, most of the two-string kites necessarily require that two people be present initially to fly the kite, one to launch it and another to control the strings. Second, most two-string kites presently available can not be flown efficaciously in variable wind speeds of between 10–25 miles per hour without adjusting the point of attachment of the string s to the kite. In kite flying competition, it is highly advantageous to have a kite that can perform different maneuvers without having to make such adjustments so as to avoid grounding the kite and losing competition time needed to make the necessary changes.

Third, most two-string kites cannot readily perform direct overhead 360-degree turns. Last, two-string kites are, for the most part, limited to being flown in winds of up to 25 miles per hour and not higher.

SUMMARY OF THE INVENTION

A two-string kite is described that is easily assembled and highly maneuverable in both low and high winds. The kite exhibits a substantially delta-shaped frame made of lightweight material with a central support member fixed aft and running forward connecting at the midpoint of the nose. Additionally, the frame contains a pair of lateral members situated on either side of the central support member, and a pair of middle members, one member of each pair being situated between the central support and lateral members. Further, there are two parallel horizontal crossbars spaced rearward from the nose of the kite. The central support member connects aft of the nose to the rearmost horizontal crossbar, while the lateral and middle members are enclosed and connect to sail material at the rear. The frame of the kite is covered with lightweight sail material, and a bridle is used to attach two strings to the kite.

DETAILED DESCRIPTION OF THE INVENTION

Figure 1:
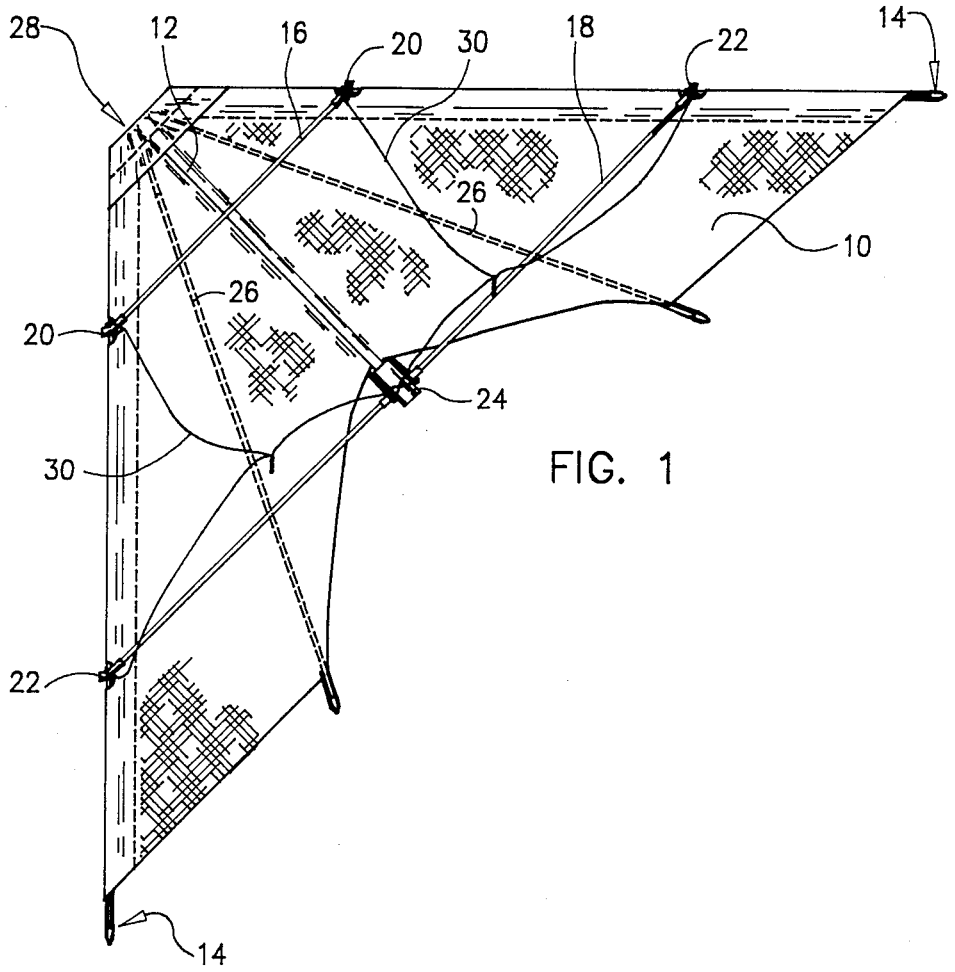
FIG. 1 shows the two-string kite viewed from the underside.

Referring now to FIG. 1, the kite is shown to comprise a cover of flexible material 10 that is arranged below a supporting substantially flexible delta-shaped frame comprising a fore and aft central support member 12 connected with the foremost and rearmost edge portions of the cover to limit the upward movement of the longitudinally central portion of the cover, and lateral frame members 14 connected respectively with the lateral edge portions of the cover and so arranged with relation to the central fore and aft frame member so as to permit the lateral portions of the cover between the lateral frame member and the central support member of the cover to move upwardly between these members when the kite is in flight. Additionally, the frame has two parallel horizontal crossbars 16 and 18 placed at different distances from the nose of the frame and that are connected at points 20 and 22 on the lateral members. The rearmost horizontal member 18, in addition to being connected to the lateral members, is also connected to a fitting 24 to the central support member at about the midpoint of the horizontal member. Last, the frame has two further members, or middle members 26, that connect to the nose of the kite and extend rearward with each being situated between a lateral member and the central support member. The nose of the kite 28 receives the central support member, lateral members, and the middle members and is substantially flat at its end. Two strings are affixed to the kite by a bridle 30. In flight the nose curls inward catching the wind and provides or increases the maneuverability of the kite.

The central support member is connected to the nose of the kite 28 by contact with a fitting formed from reinforced flight material, particularly useful are synthetic polyester textile materials, an example being Dacron®. At the rear, the central support member is connected by contact with a fitting 24 formed particularly vinyl tubing and aluminum or other suitable material. In addition to receiving the central support member, the rear fitting receives connections from the rearmost horizontal support member 18 and thereby supports the central support member.

Figure 2:
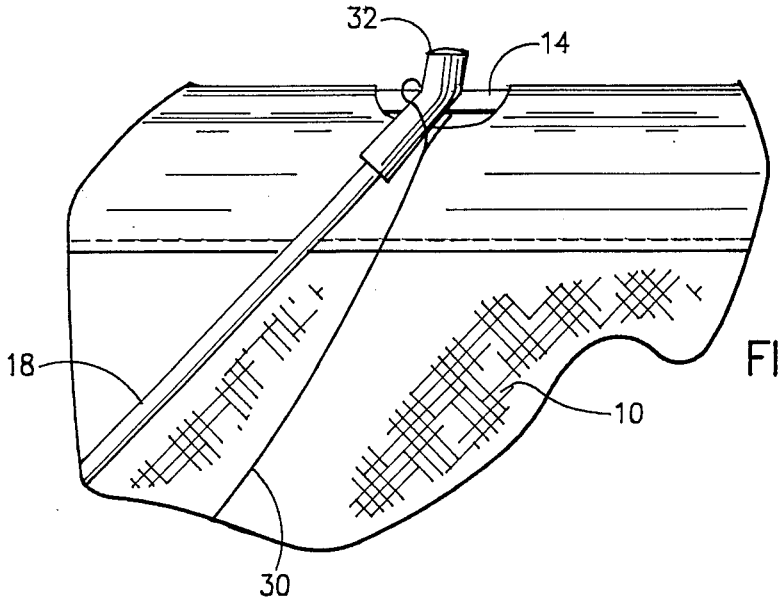
FIG. 2 shows attachment of a horizontal crossbar to a lateral member by fitting into plastic tubing.

The parallel horizontal crossbars 16 and 18 provide support to the frame and can be made of lightweight materials such as hollow fiberglass, particularly useful in Arrowshaft® fiberglass. The horizontal crossbar closest to the nose 16 attaches to the lateral members by any of several commonly used fittings that yieldably resist the movement of the fitting in the rod and retains the same in adjusting positions thereon. As shown in FIG. 2, it is convenient to employ plastic tubing or material made of soft rubber 32 with a hole of an approximate diameter the size of the crossbar and capable of receiving the same. Whereas the fitting can be attached to the lateral members in several ways, it is preferable to effect a longitudinal bore through the plastic fitting and slide it down the latter member to the desired distance from the front of the kite.

Figure 3:
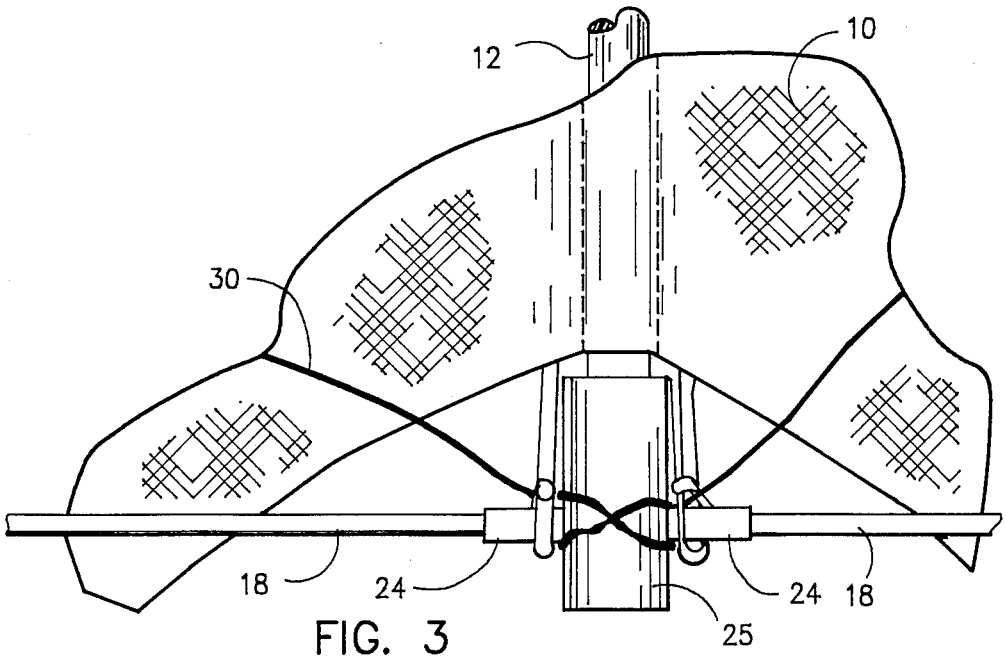
FIG. 3 shows the central support member attached to the rearmost horizontal crossbar by mutual attachment to a fitting.

The horizontal crossbar farthest from the nose of the kite 18 in its preferred embodiment is disassemblable into two sections, and allows for the kite to be readily folded and transported. Each section is connected to the lateral member independent of the other using fittings as described in the crossbar closest to the nose. Additionally, each section connects to the central support, as shown in FIG. 3, member by sliding into affixed fittings 24 attached to the central support member by way of a piece of tubing 25. This crossbar is also made of lightweight material such as hollow fiberglass, particularly Arrowshaft®.

Figure 4:
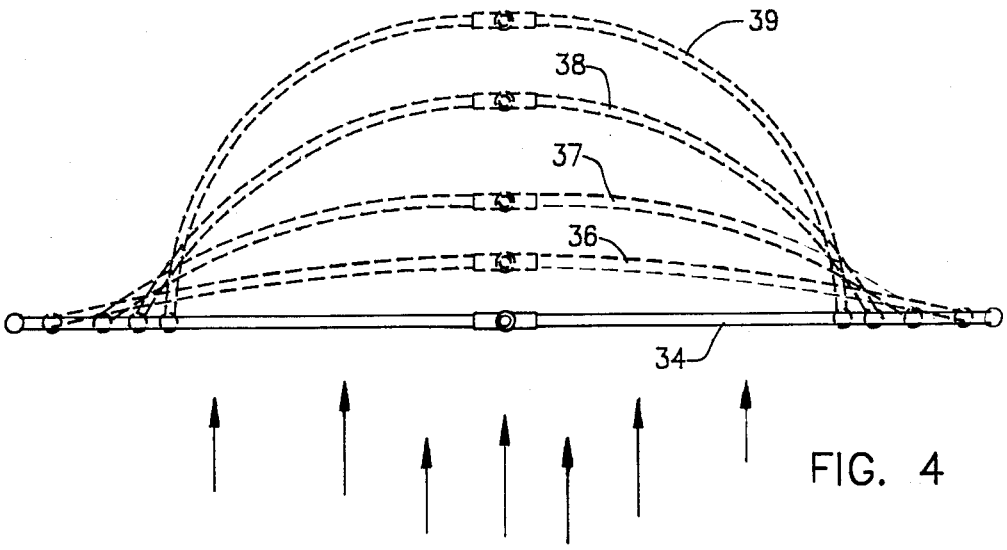
FIG. 4 shows the rearmost horizontal crossbar experiencing various degrees of flex in low, high-moderate, and high winds. The arrows denote the direction of the wind.

A property of the rearmost horizontal crossbar that contributes substantially to the kite's in-flight maneuverability is the capacity of the crossbar to flex opposite the direction of the wind to different degrees depending on the force of the wind. FIG. 4 depicts the degree of flex when the kite is stationary (34), flown in low winds about 5 knots (36) or stronger winds of 10 knots (37), 20 knots (38), or 30 knots (39). In strong winds the bar is at its greatest flex 39 while in low winds it may assume little or no flex 36. The self-adjusting property of the bar in strong winds which exerts a downward pull on the lateral regions of the kite forcing them to curl down resulting in more efficient use of the wind much akin to outriggers on boats or planes.

It is important to note that a feature associated with the use of fittings that allow either crossbar to be easily inserted and removed permits the kite to be folded and easily packaged for transport. This procedure is rapid and enables the user to launch a kite literally within a minute of removing the kite from its protective sheath.

Figure 5:
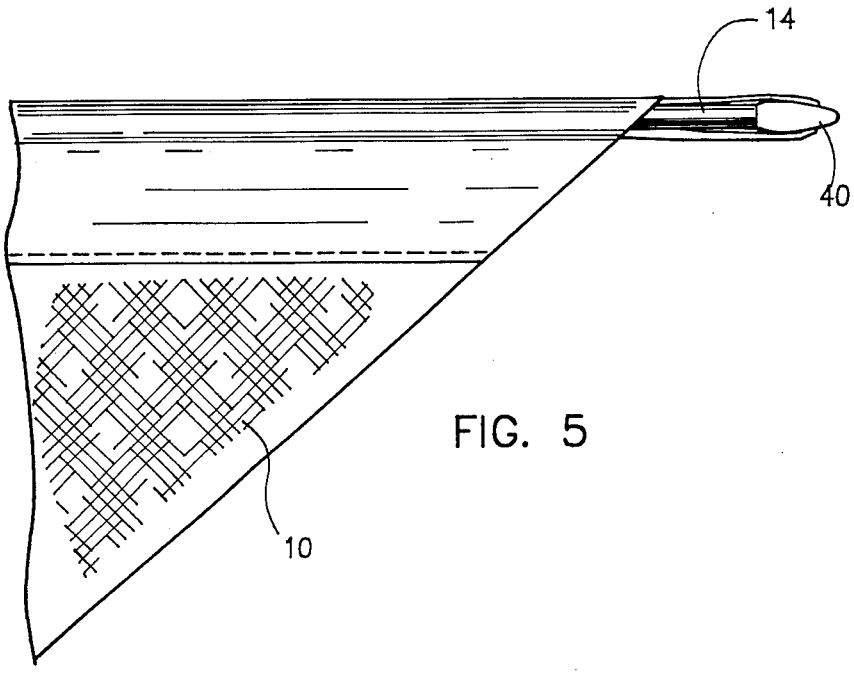
FIG. 5 shows a lateral member attached to the sail material by elastic material connecting the sail material to a notch in the lateral member.
Figure 6:
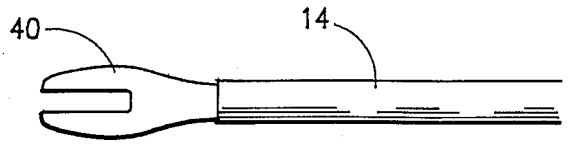
FIG. 6 shows a lateral member with an arrow shaft used to form the notch.

The middle members are attached to the nose of the kite between the central support and lateral members and are also attached at the rear by contacts with kite sail material. Such contact can be effected by string, elastic bands, grommets, or other suitable means attached to the kite sail material and the middle members. As shown in FIGS. 5 and 6, it is particularly desirable to fit this contact into a slot 40 in the rod.

Figure 7:
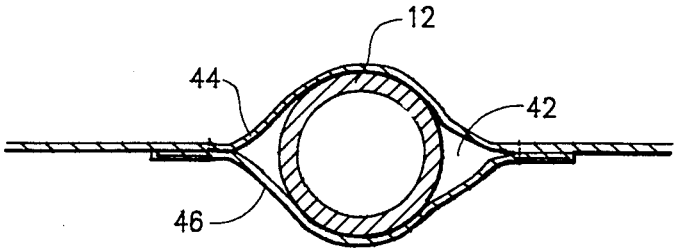
FIG. 7 shows a central support member situated inside a tunnel created by two layers of kite material.

In order to restrain the central support lateral members and middle members to maintain a set position while the kite is in flight, as depicted in FIG. 7, they are situated inside a tunnel 42 made of two layers 44 and 46 of kite material. This can be accomplished by stitching or gluing the two layers together to form a tunnel of a diameter equal to that of the members that occupy it.

The length of the central support lateral members and middle members, the angles that separate them, and the distance of the parallel horizontal crossbar from the nose establish the limits of the kites aerial maneuverability. Generally, it is anticipated that the most used version of the kite will have central support and lateral members of 28"–34" and 63"–69" long, respectively, with the middle member being 49"–55" long. The horizontal cross bars will generally be spaced 11"–17" and 42"–48" from the nose and will generally be 20"–26" and 62"–69" long, respectively. It will be understood to one skilled in the art that kites of any size can be constructed provided the dimensions are scaled up or down accordingly.

Figure 8:
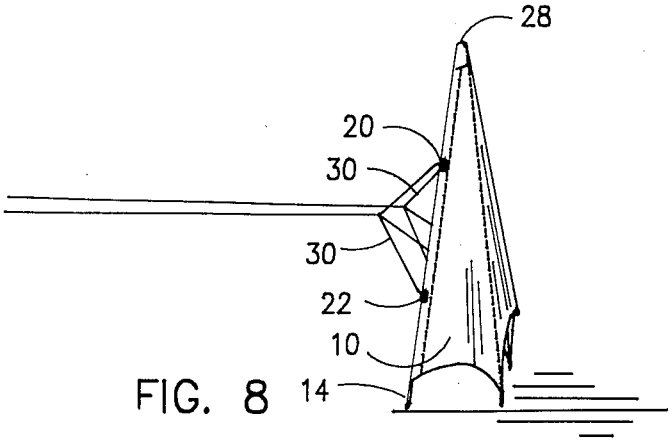
FIG. 8 shows the kite standing on its tips in the launch position.

In the assembly of the kite preparatory to flight, the parallel horizontal crossbars are inserted in to the fittings situated on the lateral members. The horizontal crossbar nearest the nose is inserted in a single step requiring insertion only into fittings on the lateral members. The crossbar farthest from the nose, being in two parts, requires that each part be inserted into fittings on both the lateral members and on the central support member. A bridle is attached to the kite at the region where the horizontal crossbars contact the lateral members and the rear of the central support member. Next, two strings or other suitable material of sufficient strength to hold the kite aloft are attached at points on the bridle. FIG. 8 shows that the kite can be launched directly from the ground, without the aid of a person to hand-launch it, by standing it on the tips of the outer frame members. When supported by the air, the upper pressure of the air on the cover moves the lateral portions thereof upwardly between the fore and aft frame members forcing the cover a minimum distance of 6"–9" near the midpoint of the two middle members.

We claim:

1. A stunt kite suitable for sailing in variable winds, comprising;

a said of flexible material;

a substantially delta-shaped frame covered by said sail and including a central rod diagonally connected at the front of said frame and extending to and connecting at the rear of said frame;

a first pair of rods lateral to and situated on either side of said central rod, extending from the front to the rear of said frame and connecting at said front and rear and extending rearwardly beyond said central rod;

a second pair of rods extending from the front to the rear of said frame and connecting at said front and rear, with one member of said second pair of rods situated adjacent either side of said central rod connecting thereto and extending rearwardly beyond said central rod; and a pair of horizontal rods connecting to said first pair of lateral rods and arranged in a parallel fore and aft relationship spaced rearwardly from the front of said kite, said aft horizontal rod of said pair capable of substantial in-flight arcuate flexibility.

2. A kite as described in claim 1 wherein said flexible material is polyester textile fiber.

3. A kite as described in claim 1 wherein said central rod is made of material drawn from the group consisting of fiberglass, wood, or plastic.

4. A kite as described in claim 3 wherein said central rod is connected to the front of said delta-shaped frame by attaching said central rod near the midpoint of the front of said delta-shaped frame.

5. A kite as described in claim 4 wherein said central rod is connected to the rear of said frame by attachment to one member of said pair of said horizontal rods wherein said member of said pair is farthest from the front of said kite.

6. A kite as described in claim 1 wherein said central rod is about 0.4–0.6 times as long as said pair of rods lateral to said central road and extending from the front to the rear of said kite.

7. A kite as described in claim 6 wherein said central rod is about 0.5–0.7 times as long as said second pair of rods extending from the front to the rear of said kite.

8. A kite as described in claim 1 wherein said pair of horizontal rods arranged in a parallel relationship from the front of said kite are about 11″–17″ and 42″–48″ from the front of said kite, respectively.

9. A stunt kite, comprising;

a substantially delta-shaped frame constructed of two lateral members running fore and aft and connecting to two horizontal members wherein said two horizontal members are in parallel relation and are spaced rearwardly from the nose of the kite, wherein one of the horizontal members is spaced about 11″–17″ and the other horizontal member about 42″–48″ from said nose of said kite, said one horizontal member is about 20″–26″ and said other horizontal member is 62″–69″ long, said other horizontal member being substantially flexible;

a central support member running rearwardly and diagonally from the front of said delta-shaped frame and said central support member being shorter than said two lateral members;

two middle members longer than said central support member running fore and aft situated one on either side of said central support member and adjacent to said two lateral members wherein said two lateral members, said two middle members, and said central support member are in contact with a flexible sail material and are 63″–69″, 49″–55″, and 28″–34″ long, respectively; and a means for asserting directional movement of said kite.

10. A kite as described in claim 9 wherein said means asserting directional movement of said kite comprises a bridle contacting said kite at or near the points of contact of said two horizontal members with said two lateral members, and at or near the rear of said central support member.

11. A kite as described in claim 10 wherein said horizontal member spaced 42″–48″ from the nose of said kite detaches into two near equal-size sections.

12. A kite as described in claim 10 wherein said horizontal member spaced 42″–48″ from the nose of said kite attaches to said central support member by connecting said near equal-size sections of said horizontal member to said central support member.

13. A kite as described in claim 9 wherein said central support member, said two middle members, and said two lateral members contact said flexible sail material at the rear of said central support member, said two middle members, and said two lateral members.

* * * * *

UNITED STATES PATENT AND TRADEMARK OFFICE

CERTIFICATE OF CORRECTION

PATENT NO. : 4,736,914

DATED : April 12, 1988

INVENTOR(S) : Donald C. Tabor

It is certified that error appears in the above-identified patent and that said Letters Patent is hereby corrected as shown below:

Column 4, claim 1, line 66 "said" should be --sail--.

Signed and Sealed this

Thirtieth Day of August, 1988

*Attest:*

*Attesting Officer*

DONALD J. QUIGG

*Commissioner of Patents and Trademarks*